United States Patent [19]

Madsen

[11] 4,094,167

[45] June 13, 1978

[54] HEAT PUMP ASSEMBLY

[75] Inventor: Henning Brinch Madsen, Greve Strand, Denmark

[73] Assignee: Svenska Geotherm Aktiebolag, Karlstad, Sweden

[21] Appl. No.: 664,028

[22] Filed: Mar. 4, 1976

[51] Int. Cl.[2] ..... F25B 27/02; F25B 13/00; F25D 11/00

[52] U.S. Cl. ..... 62/238; 62/97; 62/160; 165/18; 237/2 B

[58] Field of Search ..... 62/160, 238, 122, 93, 62/97; 237/2 B; 165/18, 28, 29

[56] References Cited

U.S. PATENT DOCUMENTS

| | | | |
|---|---|---|---|
| 2,048,137 | 7/1936 | Palmer | 62/97 |
| 2,060,636 | 11/1936 | Persons | 165/18 |
| 2,266,238 | 12/1941 | Newton | 237/2 B |
| 2,567,758 | 9/1951 | Ashley | 62/97 |
| 2,693,939 | 11/1954 | Marchant et al. | 237/2 B |
| 2,721,728 | 10/1955 | Higgins | 62/238 |
| 2,748,572 | 6/1956 | Parcaro | 62/160 |
| 2,751,761 | 6/1956 | Borgerd | 62/238 |
| 2,801,524 | 8/1957 | Fifield | 62/160 |
| 2,860,493 | 11/1958 | Capps et al. | 62/238 |
| 2,975,609 | 3/1961 | Allander et al. | 62/97 |
| 3,188,829 | 6/1965 | Siewert et al. | 62/238 |
| 3,513,663 | 5/1970 | Martin, Jr. et al. | 62/238 |
| 3,916,638 | 11/1975 | Schmidt | 62/238 |

*Primary Examiner*—Lloyd L. King
*Attorney, Agent, or Firm*—Larson, Taylor and Hinds

[57] ABSTRACT

An assembly for dehumidifying air, such as in swimming pool enclosures, comprises a heat pump system including a compressor, an evaporator, a condenser and a thermostatic expansion valve. A brine liquid system forms a closed loop through which brine liquid is circulated, and the brine is maintained at a temperature below the dew point of the air by, for instance, circulating the brine through a pipe system in the earth's crust. A cooling surface is in heat-conducting communication with the evaporator and with the brine liquid. The air to be dehumidified is passed over the cooling surface to be dehumidified, and over the condenser for selective heating. The compressor can be run selectively when heating is desired, or when needed to keep down the temperature of the brine liquid. A heat exchanger connectable in series with the condenser can function to heat the water of the pool.

4 Claims, 3 Drawing Figures

HEAT PUMP ASSEMBLY

This invention relates to an assembly, including a heat pump, for dehumidifying and selectively heating air in areas such as swimming pool enclosures.

The most widespread method of dehumidifying air consists in ventilating the humid room which results in a substantial loss of heat during the heating season when the replacement air is cold. Special dehumidifier units are gradually coming into use, and such units may comprise a heat pump with associated evaporator and condenser in which the humid air condenses on a cooling surface in heat-conducting communication with the evaporator of the heat pump, after which the dehumidified air is again heated on a heating surface in heat-conducting communication with the condenser of the heat pump. It is therefore necessary that the compressor of the heat pump be operative when the air is required to be dehumidified no matter whether there is any need for the heat recovered by condensation of the water vapours and which via the heat pump is given off to the air through the condenser thereof. This is an uneconomical operating state during the summer when there is no need for heating, but where in the case of swimming baths, for instance, it is frequently required to cool the air because of incident sunlight.

It is the object of the invention to provide an assembly for dehumidifying air, where the assembly is more economical inooperation than is the case with the aforesaid prior-art systems.

In accordance with the invention, an assembly for dehumidifying air comprises a heat pump system including a compressor, an evaporator, a condenser and a thermostatic expansion valve, the assembly further including a brine liquid system forming a closed system and including means for circulating the brine liquid in the system and means for maintaining the brine liquid at a temperature below the dew point of the air, a cooling surface in heat-conducting communication with the evaporator and with the brine liquid, and means for passing air to be dehumidified past the cooling surface and from the cooling surface to the condenser. The evaporator may form a part of a heat exchanger for heat exchange between the air to be dehumidified, the brine liquid and the evaporator. A damper controlled by a hygrostat may be provided for conducting past the cooling surface a portion of the air depending on the setting of the dampers. The temperature of the brine liquid may conveniently be maintained by passing it through a piping system in the earth's crust. A second heat exchanger may be connected in series with the condenser for heat exchange from the heat pump system to the water of a swimming pool, so as selectively to heat the water of the pool.

Figure 1:
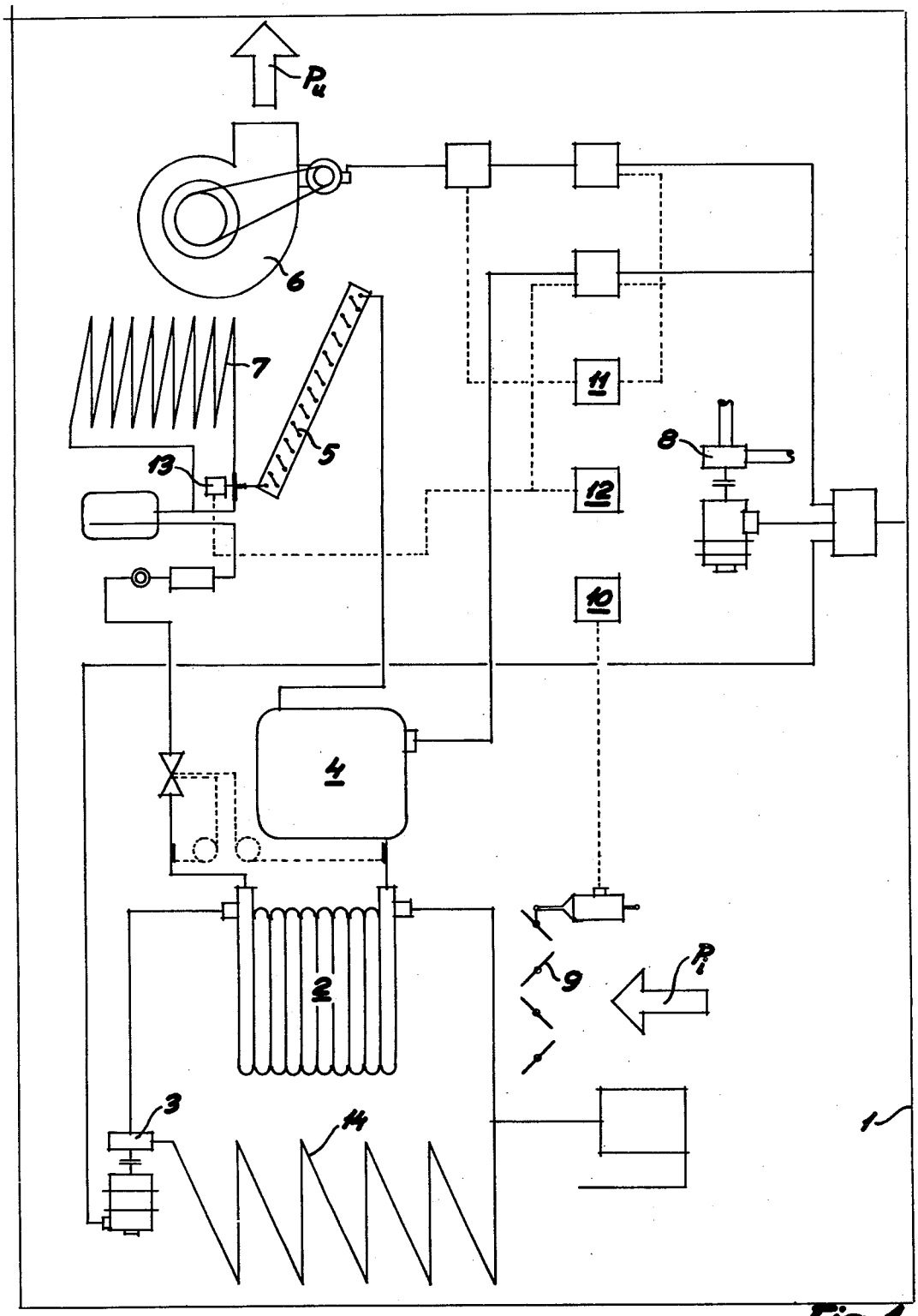
Figure 2:
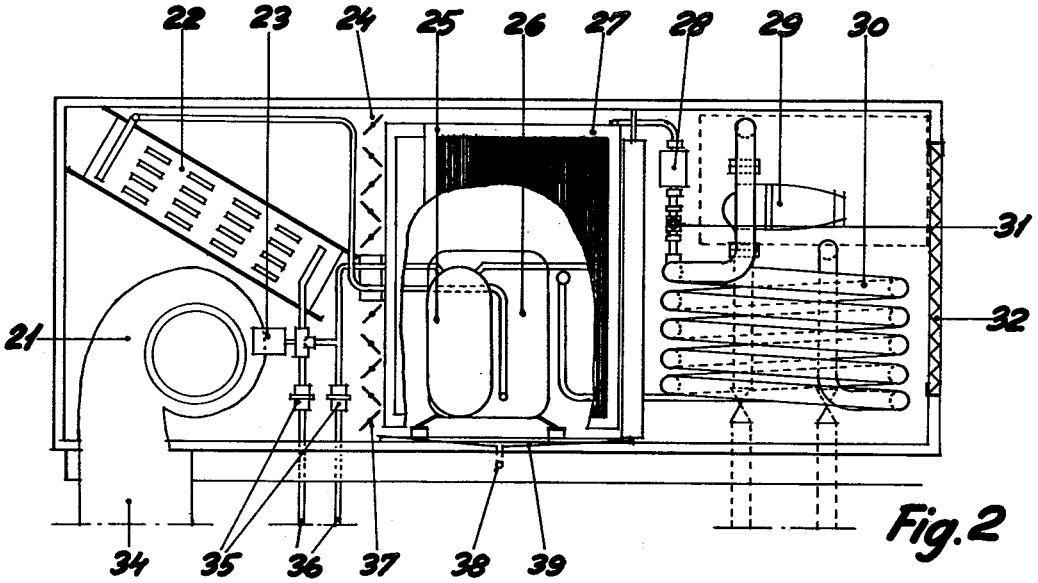
Figure 3:
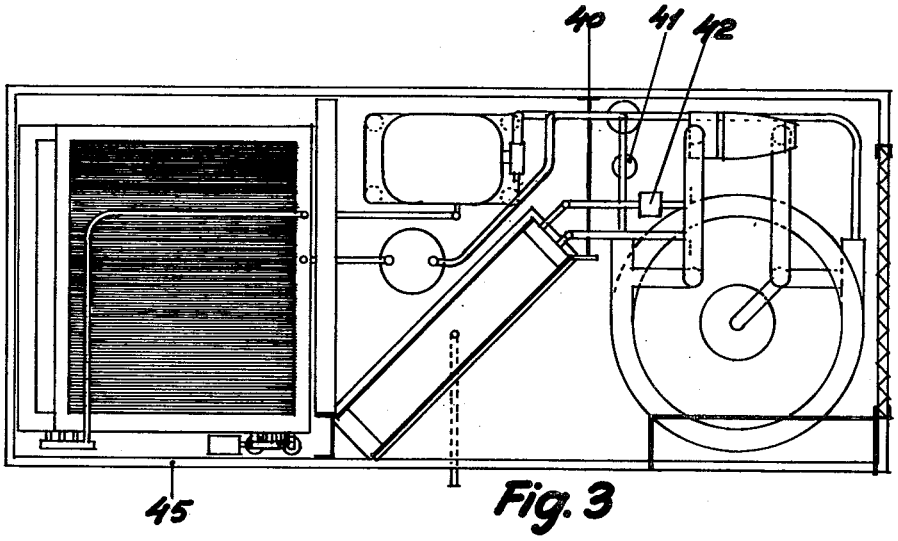

The invention will be further explained by the following description of two embodiments, reference being made to the drawings, in which FIG. 1 shows a first embodiment of the heat pump assembly according to the invention, FIG. 2 a second embodiment of the assembly according to the invention, while FIG. 3 is a top view of the embodiment shown in FIG. 2.

Both of the embodiments illustrated are adapted to dehumidify and heat the air in smaller swimming baths and further adapted to give off heat to the pool water.

The unique feature of the embodiment illustrated in FIG. 1 is the use of a single heat exchanger 2 only for providing heat exchange between the humid return air, indicated by the arrow $P_i$, a brine liquid flowing through a pipe system 14 in the earth's crust and the suction gas for a compressor 4 whose pressure pipe is connected to a condenser 5 serving as heating surface. The assembly is enclosed within a cabinet 1 which is so formed that the return air ($P_i$) may be directed to sweep the heat exchanger 2 or to bypass same by means of a damper 9 which is set automatically by a damper motor controlled by a hygrostat 10 arranged in the room. The air is propelled through the assembly by a ventilator 6, whereby the air passes the slats of the heating surface 5 and is heated if the compressor 4 is operative, and the air is ejected as indicated by the arrow $P_u$. The area of the heat exchanger 2 swept by the air of the room is provided with slats to obtain a large cooling surface whose temperature is maintained close to that of the earth's crust as a result of the brine liquid which is circulated by means of the circulating pump 3.

In the first place, the assembly according to the invention offers the advantage that the air ($P_i$) may be dehumidified by passage through the slats of the heat exchanger 2 with the compressor 4 inoperative. The thermal energy recovered by condensation of the water vapours of the air is therefore transmitted through the pipe system 14 into the earth's crust where it is accumulated rather than being given off on the heating surface 5. Dehumidification is controlled by the hygrostat 10 arranged in the humid room and also by a thermostat 11 which determines the operating period of the compressor 4. The ventilator 6 starts automatically as air circulation is required.

Secondly, the efficiency of the assembly with the compressor 4 operative may be improved by the possibility of conducting the coolant condensate from the evaporator 5 past or through a heat exchanger 7 by means of a three-way magnetic valve 13 controlled by a water thermostat 12. The heat exchanger 7 may be in heat-conducting communication with the water of a swimming pool, whereby the coolant condensate is further cooled from a temperature of about 35° C down to about 20° C, to thereby increase the efficiency factor of the heat pump. The heat exchanger 7 may conveniently form part of the filter system of the swimming pool which includes a circulating pump 8.

FIGS. 2 and 3 illustrate a second embodiment of the assembly according to the invention. The most significant distinction in relation to the earlier described embodiment is that the cooling surface 27 is physically separated from the evaporator 30 of the heat pump but is in heat-exchanging communication therewith by means of the brine liquid which is forcibly circulated through a pipe system arranged in the ground by means of the circulating pump 29. The assembly shown in FIGS. 2 and 3 is adapted to dehumidify and/or heat the air in a swimming bath and for heating the pool water. The assembly is built into a jacket with insulation 45 to silence the compressor 26 as much as possible, and the jacket is connected to an air duct 34 through which conditioned air is delivered. The assembly is further connected to a return duct for suction of humid air from the swimming bath, which air first passes a filter 32 and is thereafter, if necessary, dehumidified and/or heated as described below.

In addition to the said compressor 26 and evaporator 30, the heat pump includes a condenser 22 serving as heating surface, a coolant reservoir 25, drying filter 28, sight glass 31 and thermostatic expansion valve 41. In relation to the above described embodiment the large cooling surface 27 will increase the dehumidifying capacity, and the degree of dehumidification may, as described below, be controlled much simpler than was the case of the earlier described embodiment. By means of a delivery tray 39 the condensate from the cooling surface 27 is passed to a condensation outlet 38.

The assembly further includes means for controlling a predetermined fraction of the air flow propelled through the assembly by means of the ventilator 21 through the heating surface 22, while the remainder of the air flow bypasses the heating surface. These means comprise two motor-operated dampers 24 and 37 whose position is controlled by means of a room thermostat. This arrangement, which was not included in the earlier described embodiment, is used when the assembly is designed for a large dehumidifying capacity as it may be necessary to maintain the compressor 26 in operation to keep the temperature of the brine liquid down, although no heating of the air of the room is required. However, this will not result in superheating of the heating surface 22 as the coolant like in the former embodiment is capable of giving off its heat through a heat exchanger which is in heat-conducting communication with the filter system of the pool. By means of the pipes 36 and the single unions 35 this heat exchanger is connected to the coolant circuit across a magnetically operated three-way valve 23.

Dehumidification is controlled by means of a hygrostat arranged in the room of the swimming bath, which hygrostat controls a magnetic valve 42 adapted to shut off or admit brine liquid through the cooling surface 27. The valve 22 could also be motor-operated for adjustment of the rate of flow through the cooling surface 27. In lieu of a wall 20 in connection with the inclined cooling surface 27, the latter might extend transversely of the assembly substantially throughout the cross-sectional area thereof.

It will be appreciated from the above that the assembly shown in FIGS. 2 and 3 affords the possibility of heating and dehumidifying air and heating water most economically as no heat is wasted. The heat waste of the compressor is given off via the air flow through the assembly to the air of the room, and the energy recovered by condensation of the water vapours of the air may be accumulated in the ground, whereby the brine temperature wll increase slightly. Actually, this is an advantage as the suction pressure will thereby be higher when the energy is again given off to the air via the heating surface 22. If the compressor is operative and the heat is given off to the pool water and/or the air, the temperature of the brine may be lowered to increase the dehumidifying capacity.

What I claim is:

1. An assembly for dehumidifying air, comprising a heat pump system including a compressor, an evaporator, a condenser and a thermostatic expansion valve; a brine liquid system forming a closed system and including means for circulating the brine liquid in the system and means for maintaining the brine liquid at a temperature below the dew point of the air; a heat exchanger for heat exchange between the air to be dehumidified, the brine liquid and the evaporator, said heat exchanger forming a cooling surface; and means for passing air to be dehumidified past the cooling surface and from the cooling surface to the condenser.

2. An assembly according to claim 1 and further comprising a damper controlled by a hygrostat for conducting past the cooling surface a portion of air depending on the setting of the dampers.

3. An assembly according to claim 1, wherein said means for maintaining said temperature of the brine liquid comprises a pipe system in the earth's crust.

4. An assembly according to claim 1 and further comprising a second heat exchanger connectable in series with the condenser for heat exchange from the heat pump system to the water of a pool.

* * * * *